United States Patent [19]

Mabery

[11] 4,212,183

[45] Jul. 15, 1980

[54] UPSETTING OF TUBE ENDS

[75] Inventor: Thomas L. Mabery, Chattanooga, Tenn.

[73] Assignee: Combustion Engineering, Inc., Windsor, Conn.

[21] Appl. No.: 968,523

[22] Filed: Dec. 11, 1978

[51] Int. Cl.[2] ..... B21K 21/12

[52] U.S. Cl. ..... 72/318; 72/354; 72/359

[58] Field of Search ..... 72/318, 344, 354, 358, 72/359

[56] References Cited

U.S. PATENT DOCUMENTS

| | | | |
|---|---|---|---|
| 2,548,702 | 4/1951 | Chamberlain | 72/358 |
| 2,932,889 | 4/1960 | Kritscher | 72/342 |
| 3,224,243 | 12/1965 | Van Deberg | 72/354 |

FOREIGN PATENT DOCUMENTS

| | | | |
|---|---|---|---|
| 351222 | 6/1931 | United Kingdom | 72/359 |

*Primary Examiner*—Lowell A. Larson

*Attorney, Agent, or Firm*—William W. Habelt; Joseph Born

[57] ABSTRACT

A method and apparatus for upsetting a tube end using a one-piece upset die. The tube is heated at the end to be upset and secured in a gripper clamp so as to remain stationary during the upset operation. The upset die is hydrualically forced over the tube end and a mandrel is hydraulically positioned into the tube end. A longitudinal compressive force is then hydraulically applied to upset the tube end. The upset die is hydraulically pulled off the upset tube and thereby accomplishing removal of the tube from the one-piece die without damage to the tube or the die.

4 Claims, 6 Drawing Figures

UPSETTING OF TUBE ENDS

BACKGROUND OF THE INVENTION

The present invention relates to the art of tube manufacturing, particularly to an improved method and apparatus for upsetting tube ends.

When it is desired to make an end-to-end connection of two different-sized tubes, it is often found desirable to upset the end of one of the tubes. This involves heating the end of the tube and applying a compressive force to the heated end causing the tube wall to thicken. The shape of the resultant tube end can be controlled by providing a mandrel inside the tube and a die on its outer surface to control the thickening to the appropriate amount and direction.

FIGS. 1 and 2 illustrate the typical method used in the prior art to carry out the upsetting operation. A long gripper clamp 22 is shown clamping a tube 24 whose end is to be upset. An upset die 20, which is normally made of hardened tool steel, is secured within gripper clamp 22 and engages the end of the tube 24. The gripper clamp 22 holds the tube 24 stationary during the upsetting operation, while the upset die 20 confines the tube end in order to prevent the outer diameter of the tube from increasing during upsetting.

A hydraulic cylinder 10 is provided for applying the upset force to the tube. The hydraulic pressure inside the cylinder 10 moves a piston rod 12 that extends from the cylinder. A mandrel 16 is rigidly mounted on the piston rod 12 and is sheathed along part of its length by an upset sleeve 14 that is fixed to the mandrel 16. The piston rod 12, the upset sleeve 14, and the mandrel 16 move together. During the upsetting operation, the mandrel 16 is inserted into the tube 24 so that the upset sleeve 14 engages the face of the end of the tube 24 thereby transmitting the upset pressure. In the arrangement shown, an internal upset results wherein the outer diameter of the tube remains unchanged while its inner diameter is reduced. Accordingly, the diameter of the mandrel is somewhat less than the original inner diameter of the end of the tube 24, but when the upset pressure is applied to the tube 24 by the sleeve 14, the inner diameter of the end of the tube 24 is reduced to the diameter of the mandrel 16.

In order to remove the tube 24 after upsetting, the gripper clamp 22 and upset die 20 are split along their centerline into two halves as shown in FIG. 2 so that the halves may be separated to allow tube removal. Since a rather high compressive force is applied to the tube during the pressure stroke of the upsetting operation, these split dies tend to open up allowing the tube to extrude outward between the die halves producing an extrusion fin. The extrusion fin must be subsequently reduced by grinding. Further, the extrusion causes excessive die wear and rapid wear out.

The above-mentioned problems associated with tube upsetting would be eliminated thru the use of one-piece dies. Previous attempts at using one-piece dies have proven unsuccessful because the rather high compressive force required to upset the tube end resulted in the tube binding and thereby locking in the die and preventing removal without destroying the die.

SUMMARY OF THE INVENTION

The present invention is accordingly a method and apparatus for upsetting a tube end using a one-piece upset die without the attendant binding and locking problems encountered in the prior art.

An apparatus built according to the teachings of the present invention includes a clamp die as in the prior art arranged for clamping the tube on a part of the tube away from the tube end in order to keep the tube stationary. A mandrel is provided as in the prior art whose diameter equals the desired inner diameter of the tube end, and the mandrel is positionable inside the tube end so that it can prevent reduction of the inner diameter to less than the desired diameter. A one-piece upset die that is hollowed to form a tube cavity having the shape of the desired outer surface of the tube end is provided to prevent the outer diameter of the tube from increasing to more than the desired outer diameter when the tube end is inside the upset die. After the tube is clamped in the gripper clamp, the upset die is forced onto the tube end by means that force the upset die in the direction of the gripper clamp so as to cause the tube cavity to receive the tube end. When the mandrel has been positioned inside the tube end and the tube end has been received by the tube cavity, appropriate means apply a longitudinal compression force to the tube end in order to upset the tube. Satisfactory removal of the tube is then afforded by means for retracting the upside die from the end of the tube in the direction away from the gripper clamp.

DETAILED DESCRIPTION OF THE PREFERRED EMBODIMENT

Figure 1:
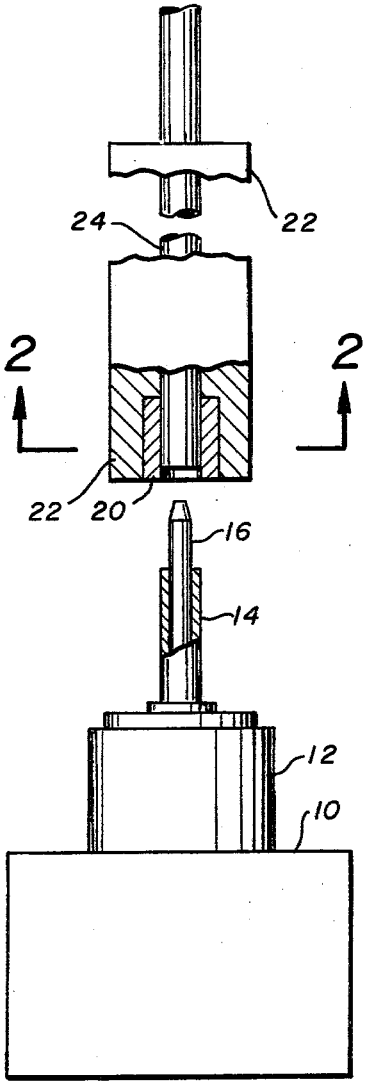
FIG. 1 PRIOR ART
FIG. 1 is a plan view of a typical prior-art upset apparatus.
Figure 2:
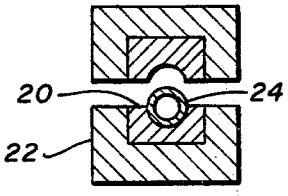
FIG. 2 PRIOR ART
FIG. 2 is a cross-sectional view of the prior-art upset apparatus of FIG. 1 taken at lines 2—2.
Figure 3:
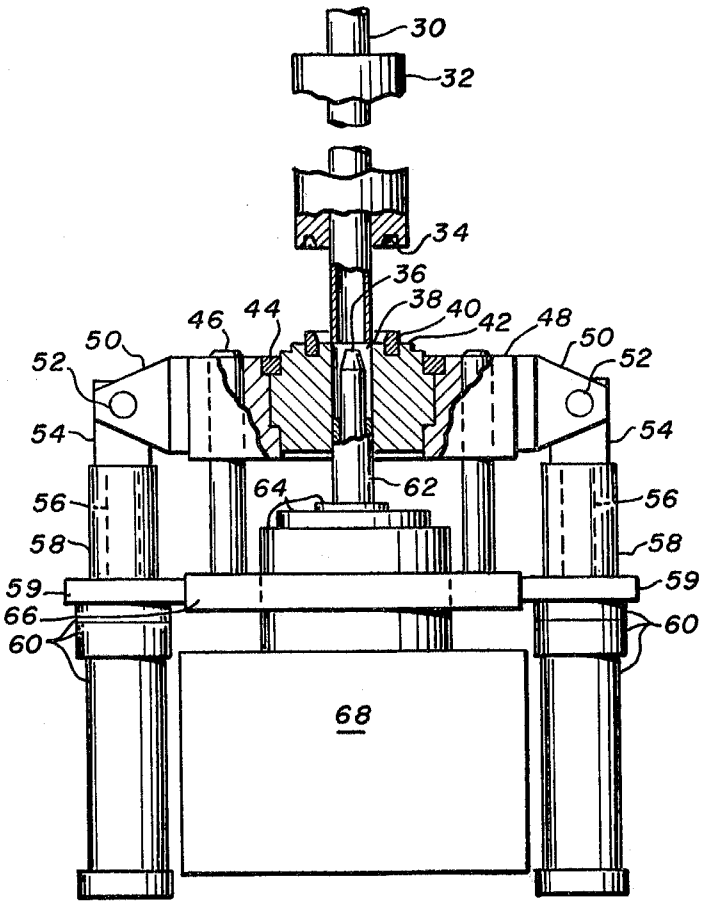
FIG. 3 is a plan view, partly in section, of an upsetting machine built according to the teachings of the present invention and shown in the position that it assumes prior to the upset operation.

FIG. 3 shows a tube 30 that has been placed in a gripper clamp 32 and oriented in the proper position for beginning the upset operation. The gripper clamp 32, similar to the gripper clamp 22 illustrated in FIG. 2, is made in two parts, one positioned on top of the other. FIG. 3 shows the tube 30 after it has been placed in the lower half of the gripper clamp and the upper half of the gripper clamp has been fixed in place.

The two hydraulic cylinders 60 for moving an upset die are suitably mounted to a foundation, and a main upset hydraulic cylinder 68 is mounted between them. A fastener plate 59 is fixed to each of the hydraulic cylinders 60, and a cylindrical stop block 58 is mounted on each of the fastener plates. Thus, the cylinders 60, fastener plates 59, and stop blocks 58 are connected to remain in a fixed position during the upsetting operation.

The stop blocks 58 are bored longitudinally and are slidably penetrated by piston rods 56 which are operated by the hydraulic cylinders 60. Each piston rod 56 has a rectangular knuckle piece 54 screwed onto its end.

Figure 4:
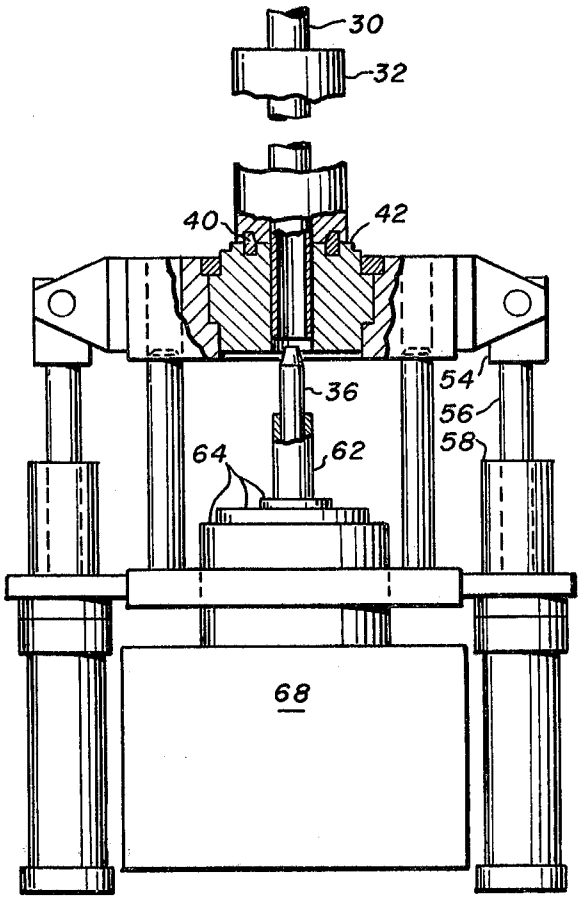
FIG. 4 shows the apparatus of FIG. 3 after the upset die has been forced onto the tube.

As seen in FIG. 3, the knuckle piece 54 is engaged by the stop block 58; but as the piston rod 56 is extended, the knuckle piece can be moved away from the stop block as shown in FIG. 4.

A die carrier 48 is positioned between the knuckle pieces 54 and is connected to them by clevises 50 attached to the knuckle pieces 54 by nuts 52. An upset die 42 is mounted in the die carrier 48 and is held in place by a retainer ring 44. The upset die 42 is hollowed to form a tube cavity 38 that has the shape of the desired outer surface of the tube end. An annular positioning ring 40 is mounted on the upset die, encircling the tube cavity 38. The positioning ring 40 is shaped to fit in an annular guide groove 34 in the gripper clamp 32.

The main hydraulic cylinder 68 operates a main piston rod 64 which slidably penetrates a rectangular mounting plate 66 fastened between fastener plates 59. The mounting plate 66 is therefore stationary with respect to the hydraulic cylinders 60 and 68, and the relative positions of cylinders 60 and 68 are determined by the mounting plate 66. The piston rod 64 has a cylindrical mandrel 36 with a tapered leading portion mounted on it, and the mandrel 36 is sheathed along part of its length by an annular upset sleeve 62. In FIG. 3, the upset sleeve 62 and mandrel 36 are shown positioned inside the side cavity 38.

Extending perpendicularly from the rectangular mounting plate 66 are four guideposts 46 that penetrate four holes in the die carrier 48. The die carrier 48 is arranged to slide on the posts and thereby maintain its proper relationship with respect to the mandrel 36.

The upsetting operation beings with the die carrier 48 in the fully retracted position shown in FIG. 3. The tube 30 is heated to a forging temperature at the end to be upset, and that end is then positioned at the entrance to the tube cavity 38. This would in general be a manual operation, and the frictional force that would have to be applied to push the tube into the tube cavity 38 is more than could be supplied by a man. When the tube 30 is in the correct position, the gripper clamp 32 is closed so that the tube remains stationary during the upset operation. Hydraulic cylinders 60 are then actuated to extend piston rods 56 thereby forcing upset die 42 onto the tube end in the direction of the gripper clamp so as to cause the tube cavity 38 to receive the tube end. That upset die 42 travels along the correct path is insured by guideposts 46, and the engagement of the guide groove 34 by the guide ring 40 insures that the upset die 42 and the gripper clamp 32 are lined up correctly as shown in FIG. 4.

Figure 5:
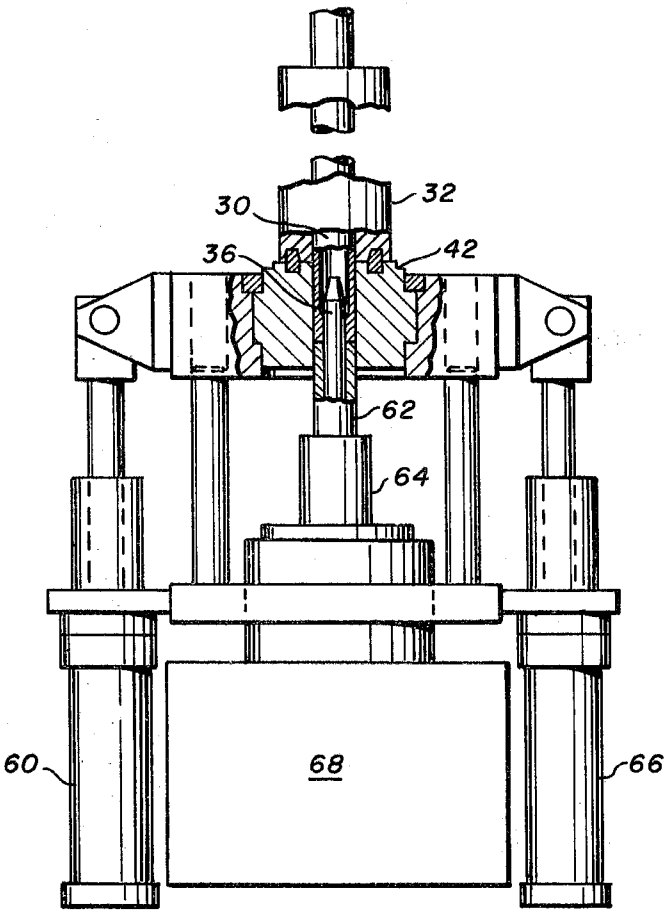
FIG. 5 shows the apparatus of FIG. 3 after the mandrel has been inserted into the tube and the sleeve is applying a compression force to it.

Once the upset die 42 has been positioned on the tube end, the main hydraulic cylinder 68 is activated to extend the piston rod 64 and thus the mandrel 36 and sleeve 62 as shown in FIG. 5. The mandrel is thereby positioned inside the tube end, and the upset sleeve 62 applies a longitudinal compression force to the tube end. This upsets the tube end reducing the inner diameter of the tube end to the diameter of the mandrel 36.

Figure 6:
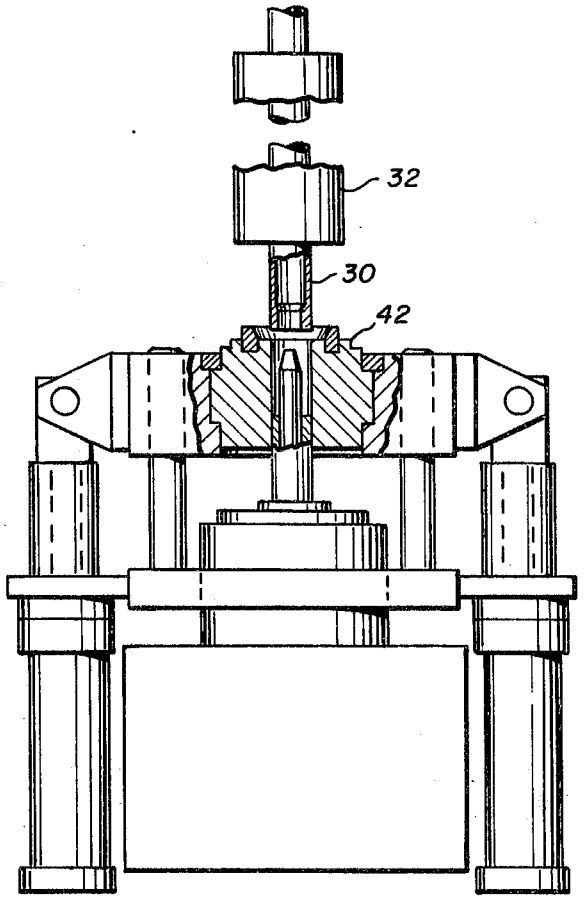
FIG. 6 shows the apparatus of FIG. 3 after the mandrel, sleeve, and die have been retracted.

It is at this point that prior-art attempts to employ a onepiece upset die came to grief. In the prior art, it was necessary to slightly loosen the gripper clamp and push the tube 30 out of the upset die back through the split gripper clamp, typically by forcing the upset sleeve 62 through the gripper clamp. In most cases this did not work because the tube would bind in the die and become locked there, thus necessitating destruction of the die or the tube. According to the present invention, however, the main cylinder 68 retracts the mandrel 36 from the tube 30 and sleeve 62 from the tube cavity 38 in upset die 42 while hydraulic cylinders 60 remain extended thereby holding the upset die stationary. After the main cylinder 68 has been fully retracted, hydraulic cylinders 60 retract thereby pulling upset die 42 off from the tube in the direction away from the clamp die as shown in FIG. 6. It has been found that a one-piece die can be successfully removed in this manner without damage as binding and locking do not occur since the tube remains securely clamped in position and is no longer subjected to a compressive bending moment because the upset die is pulled off the tube, rather than the tube being pushed out of the upset die as in the prior art.

Though the present invention has been described in connection with a specific embodiment, particularly suitable for internal upsetting of tube ends, many alterations, modifications, and variations, such as adapting the invention for external upsetting of tube ends, will be apparent to those skilled in the art in light of the foregoing disclosure. Accordingly, it is intended to include all such alterations, modifications, and variations as fall within the spirit and broad scope of the appended claims.

I claim:

1. An apparatus for upsetting the end of a tube to achieve a desired inner diameter and a desired outer diameter at the upset tube end, comprising:

a. a gripper clamp positioned for clamping the tube on a portion of the tube away from the tube end in order to hold the tube stationary during the upsetting operation;

b. a mandrel having a diameter equal to the desired inner diameter and being positionable inside the tube end during the upsetting operation so as to prevent reduction of the inner diameter of the upset tube end to less than the desired inner diameter;

c. a one-piece upset die having a tube cavity shaped so as to prevent the outer diameter of the upset tube end from increasing to more than the desired outer diameter;

d. means for forcing the upset die onto the tube end so as to cause the tube cavity to receive the tube end;

e. means for positioning the mandrel inside the tube end before the upsetting force is applied and for withdrawing the mandrel from inside the upset tube end;

f. means for applying a longitudinal compression force to the tube end while the mandrel is positioned inside the tube end an the tube end is disposed within the tube cavity of the upset die; and g. means for retracting the upset die from the upset tube end in a direction away from the gripper clamp while the tube remains clamped in the gripper clamp.

2. An apparatus for upsetting the end of a tube as recited in claim 1, wherein:

a. the gripper clamp has an annular guide groove in the end face thereof facing the tube end; and b. an annular positioning ring shaped to fit in the annular guide groove of the gripper clamp is mounted on the upset die so as to engage the annular guide groove of the gripper clamp when the upset die is forced onto the tube thereby ensuring that the upset die and the gripper clamp are lined up correctly.

3. An apparatus for upsetting the end of a tube as recited in claim 2, wherein the means for forcing the upset die onto the tube end and the means for retracting the upset die from the upset tube end comprise:

a. a first hydraulic cylinder and a second hydraulic cylinder for moving the upset die, the cylinders being mounted to a foundation on opposite sides of the tube in the plane of and parallel to the axis of the tube and each other;

b. a first and a second piston rod, the first piston rod operatively associated with the first hydraulic cylinder and the second piston rod operatively associated with the second hydraulic cylinder;

c. a first and a second fastener plate, the first fastener plate fixed to the face of the first hydraulic cylinder and slidably penetrated by the first piston rod, and the second fastener plate fixed to the face of the second hydraulic cylinder and slidably penetrated by the second piston rod;

d. a mounting plate, disposed between first and second fastener plates and secured thereto, being slidably penetrated by the means for positioning the mandrel into and for withdrawing the mandrel from the inside of the tube end;

e. a first and second stop block, the first stop block fixed to the first fastener plate and slidably penetrated by the first piston rod, and the second stop block fixed to the second fastener plate and slidably penetrated by the second piston rod;

f. a plurality of guideposts extending perpendicularly from the mounting plate;

g. a first and a second knuckle piece, the first knuckle piece secured to the end of the first piston rod and the second knuckle piece secured to the end of the second piston rod;

h. a first and a second clevis, the first clevis pinned to the first knuckle piece and the second clevis pinned to the second knuckle piece;

i. a die carrier for holding the one-piece upset die, the die carrier being positioned between the first and second knuckle pieces and connected thereby by the clevis and being slidably penetrated by the guideposts; and j. means associated with the die carrier for retaining the upset die within the die carrier.

4. A method of upsetting the end of a tube to achieve a desired inner diameter and a desired outer diameter at the upset tube end, comprising:

a. heating the tube end to a forging temperature;

b. clamping the tube on a portion of the tube away from the tube end so as to hold the tube stationary during the upsetting operation;

c. forcing over the end of the tube in the direction of the clamped portion of the tube, a one-piece upset die having a cavity shaped to confine the outer diameter of the upset tube end to the desired outer diameter;

d. inserting a mandrel whose diameter is equal to the desired inner diameter of the upset tube end into the tube end;

e. applying a longitudinal compressive force to the tube end so as to upset the tube end; and f. retracting the one-piece upset die from the upset tube end in a direction away from the clamped portion of the tube while the tube remains stationary.

* * * * *